US008718511B2

(12) United States Patent
Hale et al.

(10) Patent No.: US 8,718,511 B2
(45) Date of Patent: May 6, 2014

(54) IMAGING UNIT HAVING A PIVOTING, COLLAPSIBLE HANDLE

(75) Inventors: Jason Paul Hale, Richmond, KY (US); Matthew Lee Rogers, Lexington, KY (US); Keith Seaman, Lexington, KY (US); Katrina Lactuan, Cebu City (PH)

(73) Assignee: Lexmark International, Inc., Lexington, KY (US)

( * ) Notice: Subject to any disclaimer, the term of this patent is extended or adjusted under 35 U.S.C. 154(b) by 160 days.

(21) Appl. No.: 13/400,225

(22) Filed: Feb. 20, 2012

(65) Prior Publication Data

US 2013/0170854 A1 Jul. 4, 2013

Related U.S. Application Data

(60) Provisional application No. 61/581,872, filed on Dec. 30, 2011.

(51) Int. Cl.
*G03G 15/00* (2006.01)

(52) U.S. Cl.
USPC ..... 399/110; 399/111; 399/262

(58) Field of Classification Search
USPC ..... 399/110, 111, 262
See application file for complete search history.

(56) References Cited

U.S. PATENT DOCUMENTS

| | | | | | |
|---|---|---|---|---|---|
| 4,583,832 | A * | 4/1986 | Kasamura et al. | ..... | 399/119 |
| 4,839,691 | A * | 6/1989 | Tagawa et al. | ..... | 399/12 |
| 5,812,910 | A * | 9/1998 | Kim | ..... | 399/111 |
| RE36,301 | E * | 9/1999 | Kai et al. | ..... | 399/113 |
| D552,671 | S * | 10/2007 | Uemura et al. | ..... | D18/43 |
| 2005/0084288 | A1 * | 4/2005 | Yoo et al. | ..... | 399/116 |
| 2008/0025756 | A1 * | 1/2008 | Ahn et al. | ..... | 399/110 |
| 2010/0119264 | A1 * | 5/2010 | Yamaguchi et al. | ..... | 399/262 |
| 2010/0247137 | A1 * | 9/2010 | Akaike et al. | ..... | 399/110 |
| 2012/0020699 | A1 * | 1/2012 | Kamimura | ..... | 399/111 |
| 2012/0027462 | A1 * | 2/2012 | Nozawa | ..... | 399/122 |
| 2012/0195628 | A1 * | 8/2012 | Kato | ..... | 399/110 |

FOREIGN PATENT DOCUMENTS

| | | | | | |
|---|---|---|---|---|---|
| JP | 62209571 | A * | 9/1987 | ..... | G03G 15/08 |
| JP | 08220819 | A * | 8/1996 | ..... | G03G 15/08 |
| JP | 2008090121 | A * | 4/2008 | | |

* cited by examiner

*Primary Examiner* — G. M. Hyder

(57) ABSTRACT

An imaging unit of an image forming apparatus is provided including a handle mechanism. The imaging unit includes at least one of a photoconductor unit and a developer unit for developing a toner on the photoconductor unit. The handle mechanism is mounted on a frame portion of the housing and is configured to pivot between a collapsed position and an extended position. When in the collapsed position, the handle mechanism is substantially flush with a surface of the housing to accommodate a toner cartridge. When in the extended position, the handle mechanism automatically returns to the collapsed position by gravity when released from a user's grip.

21 Claims, 8 Drawing Sheets

IMAGING UNIT HAVING A PIVOTING, COLLAPSIBLE HANDLE

CROSS REFERENCES TO RELATED APPLICATIONS

Pursuant to 35 U.S.C. §119, this application claims the benefit of the earlier filing date of Provisional Application Ser. No. 61/581,872, filed Dec. 30, 2011, entitled "Imaging Unit Having a Collapsible Handle," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Technical Field

The present disclosure relates to imaging devices. More particularly, it relates to an imaging unit of an electrophotographic imaging device.

2. Description of the Related Art

The art of printing images with electrophotographic technology is relatively well-known. In the field of electrophotographic imaging devices, a current architecture of the devices requires that supplies, such as the imaging unit, be loaded from the front side and follow a loading path that has a considerable horizontal orientation. The manner of loading requires that a user hold the imaging unit steadily in a somewhat horizontal position to successfully and smoothly insert the unit into the device. Since the effective weight of some imaging units is greatly concentrated on the leading portion of the imaging unit, the imaging unit has the tendency to droop when being held. Therefore, the handle and frame need to be designed such that it would address this condition so that the user can relatively easily control the imaging unit during loading.

Accordingly, a need exists to provide an improved handle-frame for imaging units of electrophotographic imaging devices.

SUMMARY OF THE INVENTION

The above-mentioned and other problems become solved with a handle mechanism mounted on a frame portion of the imaging unit housing. The handle mechanism may be configured to pivot between a collapsed position and an extended position and may be substantially flush with the surface of the housing when in the collapsed position so as to be unobtrusive following insertion in the imaging device. The handle mechanism may automatically return to the collapsed position by gravity when released from a user's grip.

The handle mechanism may include a handle member pivotably connected to the frame portion and at least one arm pivotably engaged with the handle member and slidably mounted to the frame portion.

The handle member may have a gripping segment and a pair of side segments extending in parallel relation from opposed ends of the gripping segment. Each side segment may include a first coupling mechanism for pivotably connecting the handle member to the frame portion. The at least one arm may have a first end which rotatably engages with the gripping segment and a second end sliding engaged with the frame portion.

The extended position of the handle mechanism may be defined by a first angle and a second angle, the first angle being an angle between the handle member and the frame portion while the second angle being an angle between the at least one arm and the handle member. The first angle may be between about 25 degrees and about 35 degrees and the second angle may be greater than 90 degrees.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 1:
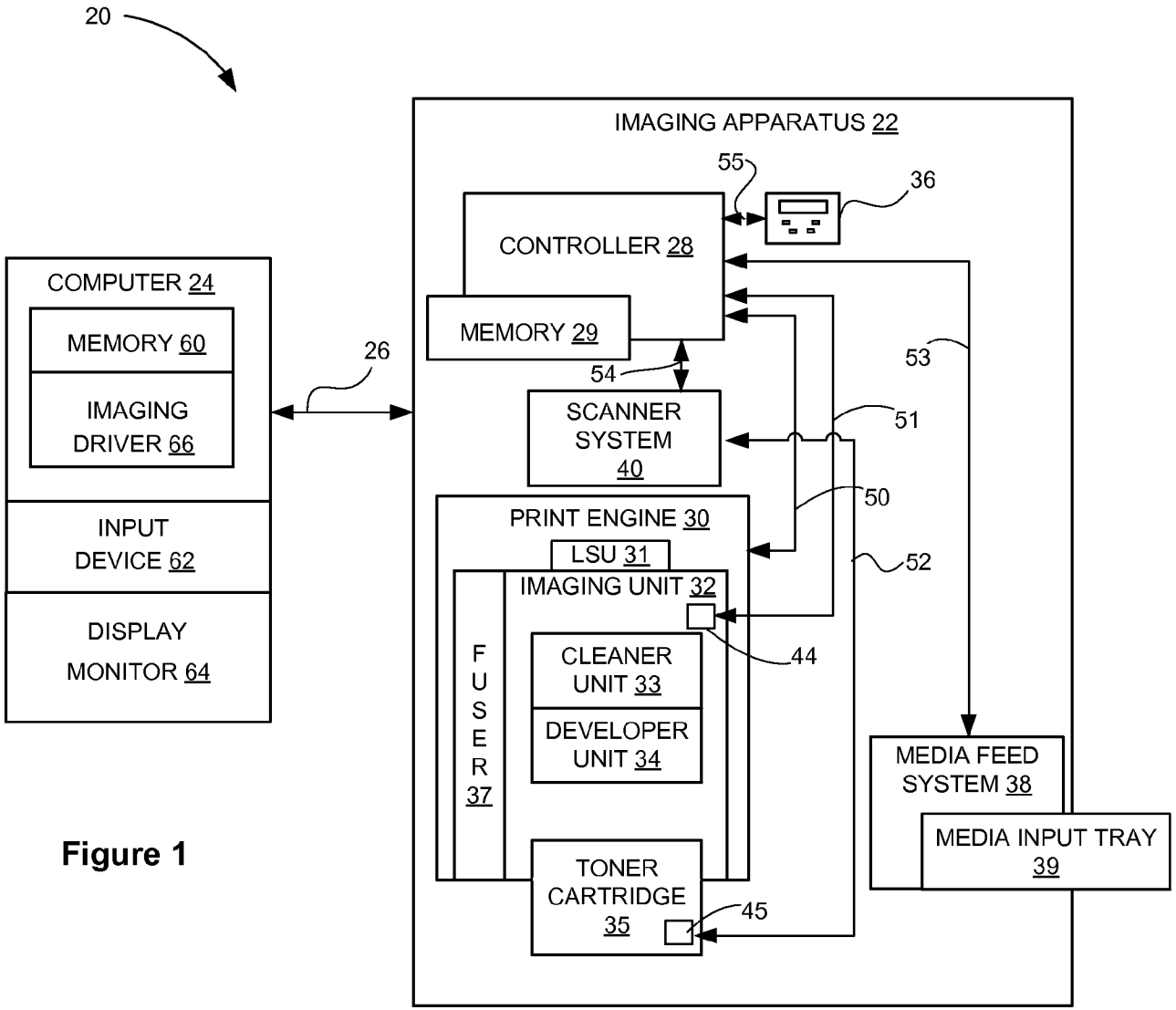
FIG. 1 is a block diagram of an example imaging system utilizing the imaging unit of the present disclosure.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use herein of "including," "comprising," or "having" and variations thereof is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are generally used in reference to the position of an element in its intended working position within an imaging device. The terms "left" and "right" are as viewed with respect to the insertion direction of a unit into the imaging device. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. The term button as used herein means any component, whether a physical component or graphic user interface icon, that is engaged to initiate output.

Referring now to the drawings and particularly to FIG. 1, there is shown a diagrammatic depiction of an imaging system 20 embodying the present disclosure. As shown, imaging system 20 may include an imaging apparatus 22 and a computer 24. Imaging apparatus 22 communicates with computer 24 via a communications link 26. As used herein, the term "communications link" is used to generally refer to structure that facilitates electronic communication between multiple components, and may operate using wired or wireless technology and may include communications over the Internet. In the embodiment shown in FIG. 1, imaging apparatus 22 is shown as a multifunction machine that includes a controller 28, a print engine 30, a laser scan unit (LSU) 31, an imaging unit 32, a developer unit 34, a toner cartridge 35, a user interface 36, a media feed system 38 and media input tray 39 and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40, or a standalone scanner system 40.

Controller 28 includes a processor unit and associated memory 29, and may be formed as one or more Application Specific Integrated Circuits (ASIC). Memory 29 may be any volatile or non-volatile memory or combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuit 44, 45 may provide authentication functions, safety and operational interlocks, operating parameters and usage information related to imaging unit 32 and toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, electronic tablet, smartphone or other hand-held electronics device, may include memory 60, such as volatile and/or non-volatile memory, an input device 62, such as a keyboard, and a display monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include laser scan unit (LSU) 31, imaging unit 32, and a fuser 37, all mounted within imaging apparatus 22. The imaging unit 32 further includes a cleaner unit 33 housing a waste toner removal system and a photoconductive drum, developer unit 34 and a toner cartridge 35 that are removably mounted within imaging unit 32. In one embodiment the cleaner unit 33 and developer unit 34 are assembled together and installed into a frame 92 to form the imaging unit 32. The toner cartridge 35 is then installed over the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

The toner cartridge 35 removably mates with the developer unit 34 in imaging unit 32. An exit port on the toner cartridge 35 communicates with an inlet port on the developer unit 34 allowing toner to be periodically transferred from the toner cartridge 35 to resupply the toner sump in the developer unit 34.

Figure 2:
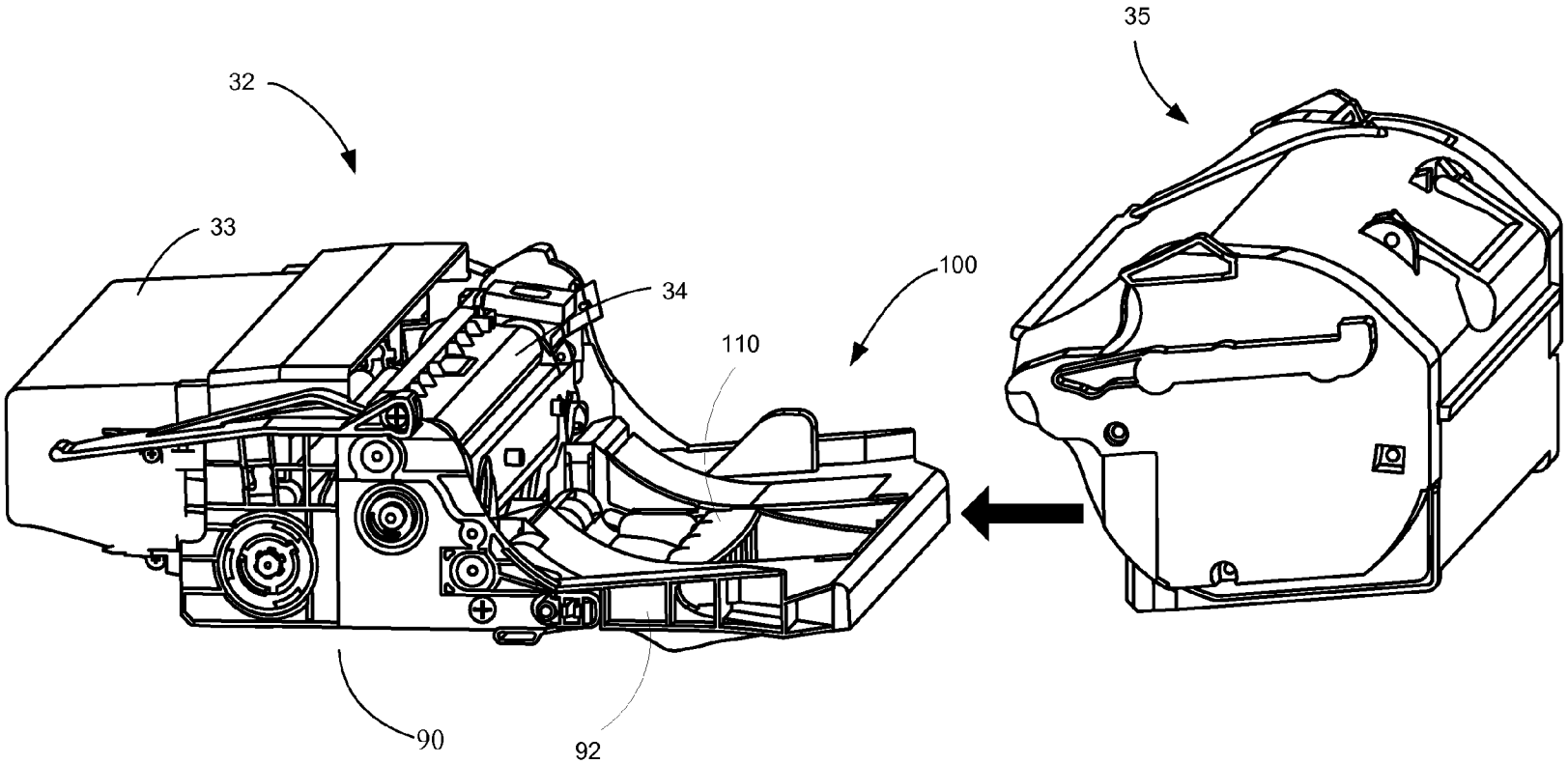
FIG. 2 is a view of the imaging unit with the handle mechanism and the toner cartridge of the system of FIG. 1.

Referring now to FIG. 2, an example embodiment of the imaging unit 32 is shown. Imaging unit 32, as illustrated, includes developer unit 34, a cleaner unit 33 and housing 90 which may contain the cleaner unit 33 and developer unit 34. Developer unit 34 and cleaner unit 33 are assembled together with frame portion 92, with toner cartridge 35 being slidably received over frame portion 92. The imaging unit 32 is initially slidably received in the imaging apparatus 22. The toner cartridge 35 is then inserted in imaging apparatus 22 over frame portion 92 and into operative engagement with developer unit 34. This arrangement allows the toner cartridge 35 to be removed and reinserted easily when replacing an empty toner cartridge without having to remove imaging unit 32. Should a media jam occur beneath the imaging unit 32, both the toner cartridge 35 and imaging unit 32 may be readily removed to allow access to the media jam. The developer unit 34, cleaning unit 33 and frame portion 92 may also be readily removed and reinserted when required, however, this would normally occur with less frequency than the removal and reinsertion of toner cartridge 35.

FIG. 2 also shows the imaging unit 32 with a handle mechanism 100 attached to a frame portion 92 of the housing 90 and adapted for relatively easily supporting of imaging unit 32. Handle mechanism 100 may include a handle member 110. The handle mechanism 100 is shown in FIG. 2 with handle member 110 in the collapsed position in which it is substantially flush with a surface of frame portion 92 when not in use. The toner cartridge 35 removably mates with the developer unit 34 of the imaging unit 32 by being positioned over handle member 110.

Figure 3:
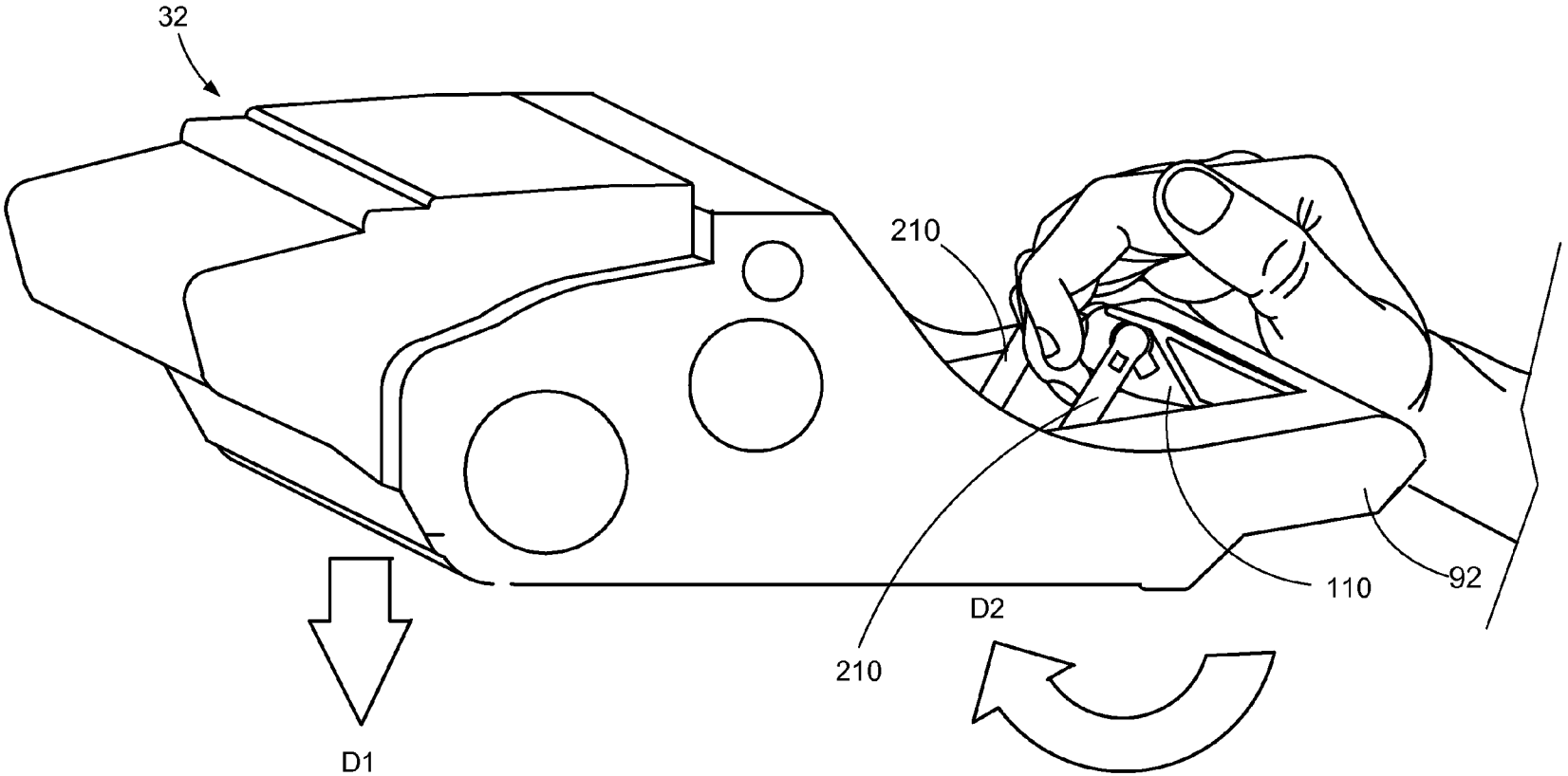
FIG. 3 is a view depicting a user holding the imaging unit of FIG. 2 using the handle mechanism.

FIG. 3 is a view depicting a user holding the imaging unit 32 through use of the handle mechanism 100. In one example embodiment of the handle mechanism 100, as shown in FIG. 3, a user may pull the handle member 110 to an extended position for lifting imaging unit 32. A pair of arms 210 is pivotably attached to handle member 110 and may limit the extent of rotational movement of the handle member 110 from the collapsed position, as explained in greater detail below. A majority of the effective weight of the imaging unit 32 may be towards the front thereof opposite the location of handle mechanism 100, and thus generates a downward force in the direction D1 as shown in FIG. 3. By grasping the handle member 110 as shown, the lower portion of the user's palm or wrist may engage or otherwise contact an end of frame portion 92, and a twisting force may be thereby provided in the direction D2 to counter the effective weight of the imaging unit 32. With the present example embodiment, a user may relatively steadily hold the imaging unit 32 during installation within imaging apparatus 22.

Figure 4:
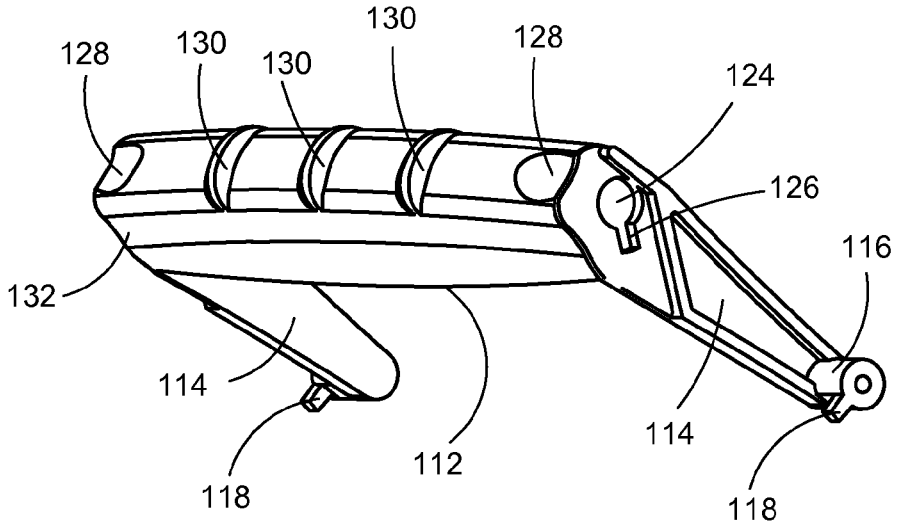
FIG. 4 is a perspective view of a handle member of the handle mechanism of FIG. 2 according to an example embodiment.
Figure 10:
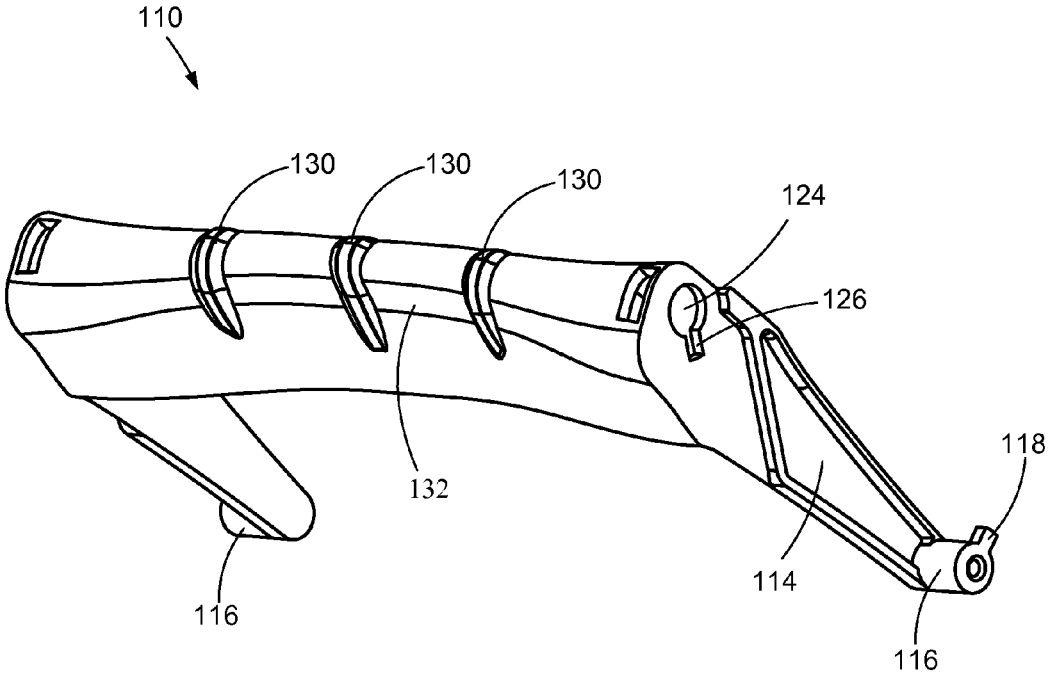

FIG. 4 is a perspective view depicting the handle member 110. As shown, the handle member 110 may include a gripping segment 112 for a user to grasp during lifting of the imaging unit 32. The gripping segment 112 may include lifting features 128 which are indentions defined along gripping segment 112 and sized to receive a user's finger to aid the user in initially lifting the handle member 110 from the collapsed position. The gripping segment 112 may also include spaced finger guides 130 to enable a user to better grip the gripping segment 112. Further, a bottom portion 132 of gripping segment 112 may be bowed (FIG. 10) in a central portion thereof away from frame portion 92 to provide an amount of clearance between a portion of gripping segment 112 relative to frame portion 92 when in the collapsed position, for more easily allowing the user to slide his/her fingers under gripping segment 112 for initially grasping same.

The handle member 110 may also include a connecting segment for connecting gripping segment 112 to frame portion 92. In the example embodiment of FIG. 4, the connecting segment includes two side segments 114 which extend from opposed ends of gripping segment 112. Each side segment includes a first coupling mechanism 116 disposed at its distal end. Each first coupling mechanism 116 may be substantially cylindrical and include a tab 118 extending substantially radially outwardly therefrom for pivotably engaging the handle member 110 to the frame portion 92, as discussed in greater detail below. It is understood that first coupling mechanism 116 may have different shapes for rotatably engaging with frame portion 92.

The handle member 110, in the present example embodiment, may also include an aperture 124 with slot portion 126 defined at either end portion of gripping segment 112.

Figure 5:
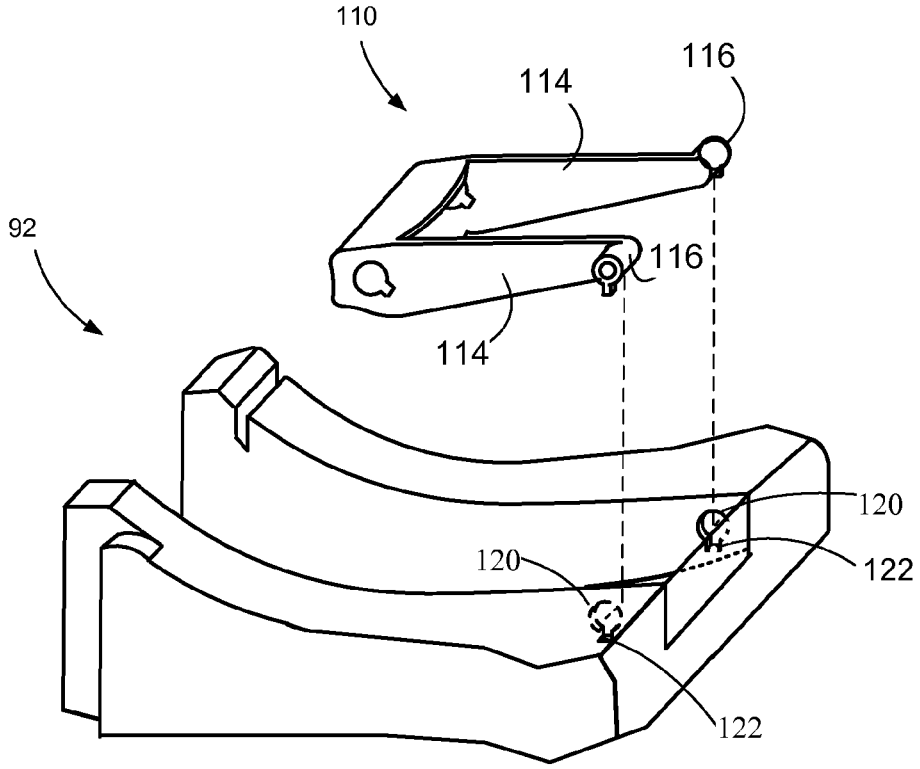
FIG. 5 is an exploded perspective view depicting the handle member and a frame portion of the imaging unit of FIG. 2.

FIG. 5 is an exploded view of the handle member 110 with frame portion 92 of housing 90. Frame portion 92 may include opposed apertures 120 with corresponding slot portions 122 that are sized for receiving first coupling mechanisms 116 of side segments 114. The first coupling mechanism 116 of each side segment 114 engages with an aperture 120 having slot portion 122. Once each first coupling mechanism 116 is engaged with a corresponding aperture 120, handle member 110 is pivotable relative to frame portion 92 about an axis defined by apertures 120. First tab 118 of each first coupling mechanism 116 prevents disconnection of side segment 114 from frame portion 92 because once first coupling mechanism 116 of side segment 114 is inserted into aperture 120 of frame portion 92 and placed in an operational position therewith, slot 122 no longer lines up with first tab 118. In an alternative embodiment, frame portion 92 includes the first coupling mechanisms 116 extending towards each other, and each side segment 114 includes at its distal end an aperture 120 with slot portion 122 for engagement with first coupling mechanisms 116.

Figure 6:
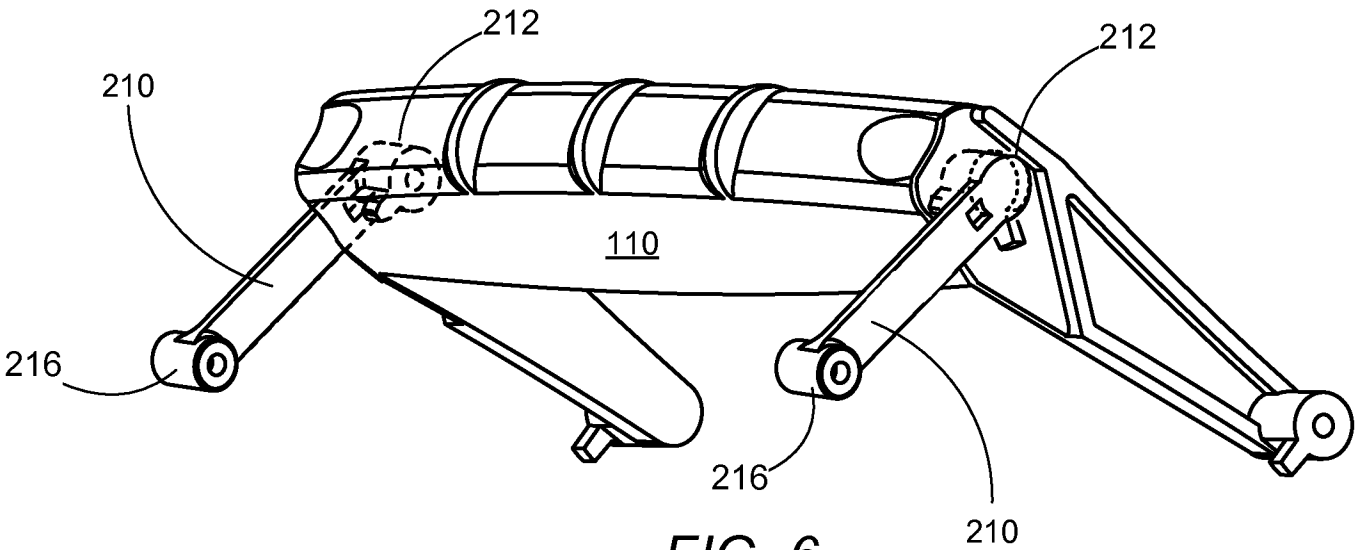
FIG. 6 is a perspective view illustrating the handle member of FIG. 4 in association with arm members of the handle mechanism according to an example embodiment.
Figure 7A:
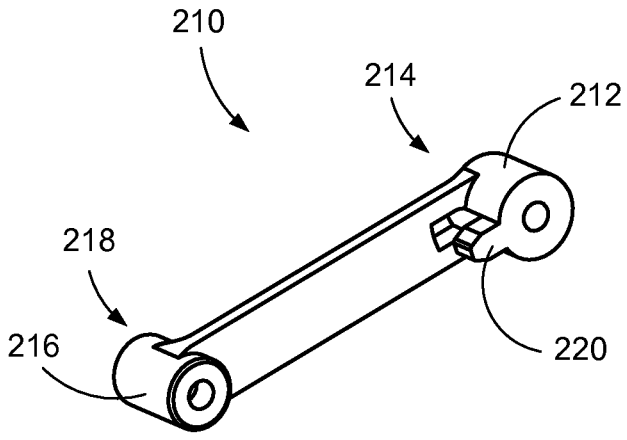
FIG. 7A depicts an arm of the handle mechanism of FIG. 6.

As mentioned, arms 210 are pivotably attached to handle member 110. FIG. 6 shows in more detail arms 210 coupled to handle member 110, and FIG. 7A illustrates details of arm 210. Arm 210 may include a second coupling mechanism 212 disposed on a first end 214 of arm 210. Second coupling mechanism 212 may include a radially extending second tab 220. Similar in structure to the first coupling mechanism 116, each second coupling mechanism 212 is operably received in an aperture 124 of gripping segment 112. Once inserted into apertures 124, second coupling mechanisms 116 allow arms 210 to pivotably rotate about gripping segment 112, and particularly about an axis defined by apertures 124 thereof. Second tab 220 prevents disconnection of arm 210 from the handle member 110 because once second coupling mechanism 212 is inserted into aperture 124 of gripping element 112 and placed in an operational position with respect to handle member 110, slot 126 of aperture 124 no longer lines up with second tab 220.

Figure 7B:
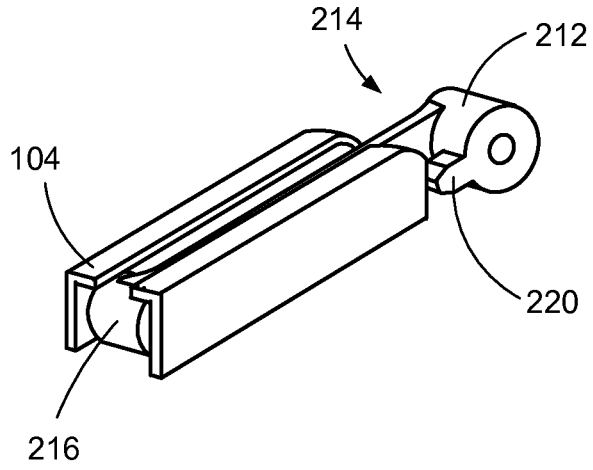
FIG. 7B depicts an arm of the handle mechanism of FIG. 6 engaged with a frame portion of the imaging unit of FIG. 2.

Arm 210 may further include a third coupling mechanism 216 disposed on an opposed second end thereof. Third coupling mechanism 216 slidingly engages with frame portion 92 and may include a rounded portion. In an example embodiment, third coupling mechanism 216 has a substantially cylindrical shape, but it is understood that third coupling mechanism 216 may have other shapes. Third coupling mechanism 216 sliding engages with tracks 104 that are disposed in substantially parallel relation along frame portion 92. FIG. 7B depicts arm 210 engaged with track 104.

Figure 8A:
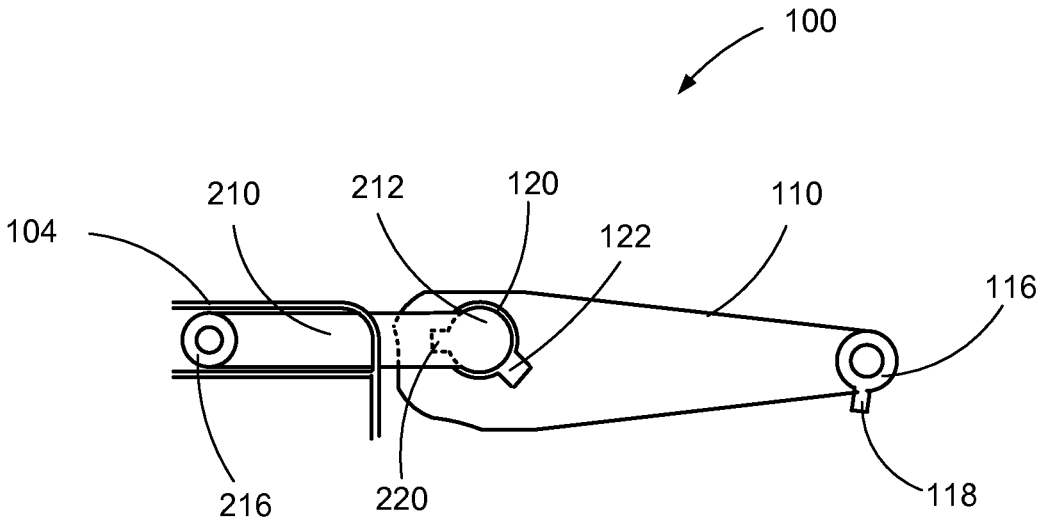
FIGS. 8A and 8B illustrate movement of the handle mechanism of FIG. 2 between collapsed and extended positions according to an example embodiment.
Figure 8B:
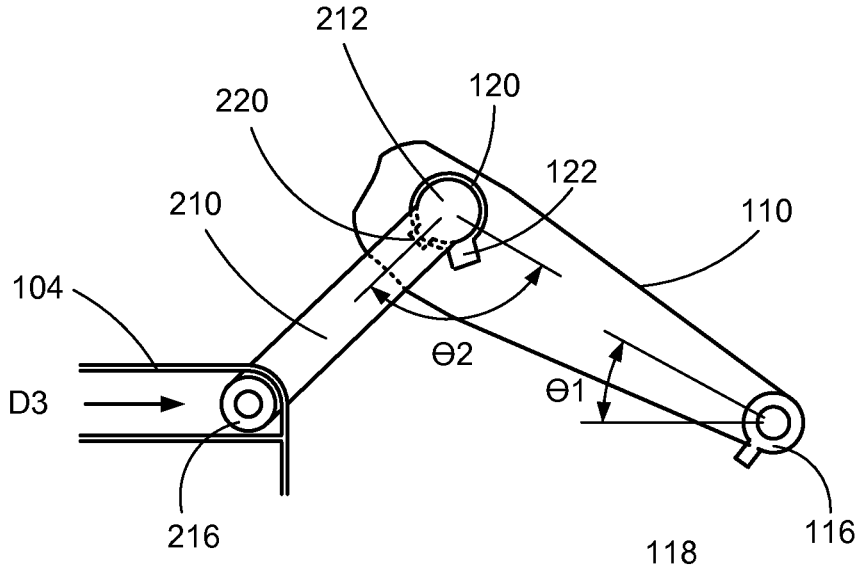

FIGS. 8A and 8B depict the handle mechanism 100 in the collapsed and extended positions, respectively. As mentioned above, each arm 210 is pivotably attached to handle member 110 and is sliding engaged with its corresponding track 104. When the handle mechanism 100 is in the collapsed position, as shown in the FIG. 8A, arms 210 are substantially parallel with side segments 114 of handle member 110, along a bottom portion of frame 92. When handle member 110 is lifted, side segments 114 pivot about frame portion 92. In addition, arms 210 slide along tracks 104 in direction D3 (FIG. 8B). Each arm 210 also pivots frame portion 92 when sliding along corresponding track 104. When the handle mechanism 100 reaches the extended position, as shown in FIG. 8B, each third coupling mechanism 216 of the arm 210 is disposed along an end portion of corresponding track 104. Each track 104 limits the extent of sliding movement of its corresponding arm 210 and as a result limits the rotational movement of the handle member 110. Specifically, in the extended position, a first angle θ1 may be defined between the side segment 114 of handle member 110 and a horizontal line traversing the pivot point of the handle member 110 substantially parallel to the orientation of the frame portion 92 of the housing 90. A second angle Θ2 may be defined between each arm 210 and the handle member 110. When handle member 110 is in the extended position, the first angle θ1 may be between about 25 degrees and about 35 degrees while the second angle θ2 may be greater than 90 degrees. The first angle θ1 and the second angle θ2 are set to enable the handle member 110 to automatically return to the collapsed position by gravity when released from a user's grip.

Figure 9:
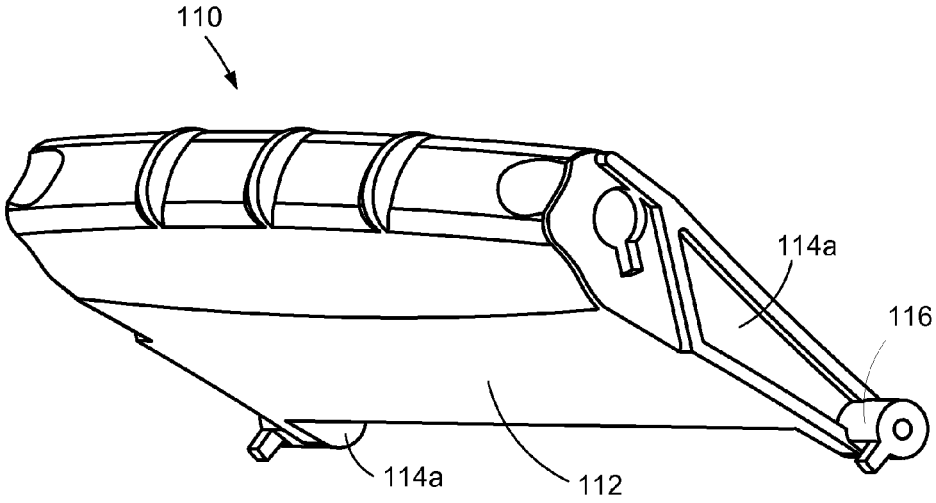
FIGS. 9 and 10 are perspective views depicting the handle member of the imaging unit of FIG. 2 according to other example embodiments.

FIG. 9 depicts another example embodiment of the handle member 110. In this example embodiment the, gripping segment 112 extends substantially between a majority of the two side segments 114 towards the first coupling mechanism 116. This extension of gripping segment 112 prevents a user's thumb from being uncomfortably slid underneath the gripping segment 112 when grasped by a user.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A removable unit of an imaging device, comprising:

at least one of a photoconductor unit and a developer unit for developing a toner on the photoconductor unit;

a housing for holding the at least one of the photoconductor unit and the developer unit, wherein the housing includes a frame portion; and a handle mechanism mounted on the frame portion and configured to pivot between a collapsed position and an extended position, the handle mechanism including, a handle member having a gripping segment and a plurality of side segments, each side segment being attached to and extending from the gripping segment and pivotably connecting the handle member to the frame portion; and a plurality of arms, each arm pivotably engaging with the handle member and slidably mounting to the frame portion;

wherein in the collapsed position, the handle member, side segments and arms are substantially flush with a surface of the frame portion.

2. The removable unit of claim 1, wherein each side segment includes a first coupling mechanism for connecting to the frame portion, and the frame portion including a plurality of apertures for receiving the first coupling mechanism of the side segments.

3. The removable unit of claim 1, wherein each side segment includes a first coupling mechanism for connecting to the frame portion, each first coupling mechanism includes a first tab extending therefrom and the frame portion includes a plurality of apertures for receiving the first coupling mechanisms of the side segments, each aperture having a slot configured to receive the corresponding first tab to prevent disconnection of the handle member from the frame portion.

4. The removable unit of claim 1, wherein each arm includes a second coupling mechanism on a first end thereof for engaging with the handle member, and a third coupling mechanism on a second end of the arm for connecting to the frame portion, the frame portion including track members for slidingly receiving the third coupling mechanism of the arms.

5. The removable unit of claim 1, the extended position being defined by a first angle and a second angle, the first angle being an angle between the handle member and the frame portion, the second angle being an angle between at least one of the arms and the handle member, wherein at least one of the first and the second angles is an acute angle.

6. The removable unit of claim 5, wherein the first angle is between about 25 degrees and about 35 degrees.

7. The removable unit of claim 5, wherein the second angle is greater than 90 degrees.

8. The removable unit of claim 1, wherein each arm includes a second coupling mechanism on a first end thereof for engaging with the handle member, and a third coupling mechanism on a second end of the arm for connecting to the frame portion, each second coupling mechanism includes a second tab to prevent disconnection of the arms from the handle member, and the handle member includes a plurality of apertures for receiving the second coupling mechanisms, each aperture including a slot configured to receive the second tab.

9. The removable unit of claim 1, wherein each arm includes a second coupling mechanism on a first end thereof for engaging with the handle member, each second coupling mechanism includes a second tab and the handle member includes a plurality of apertures for receiving the second coupling mechanisms, and each aperture including a slot configured to receive the second tab to prevent disconnection of the arms from the handle member.

10. The removable unit of claim 2, wherein the gripping segment extends substantially between two side segments towards the first coupling mechanisms to prevent a user's thumb from being slid underneath the gripping segment when in the extended position.

11. The removable unit of claim 1, wherein one side of the gripping segment is bowed in a central portion thereof for facilitating initial grasping by a user of the gripping segment when the handle mechanism is in the collapsed position.

12. The removable unit of claim 1, wherein the handle mechanism automatically returns to the collapsed position by gravity when released from a user's grip.

13. The removable unit of claim 1, wherein the gripping segment includes at least one indention for engaging with a tip of a finger of a user for facilitating initial lifting of the handle member from the collapsed position to the extended position.

14. A handle mechanism mounted on a consumable item of an imaging device and configured to pivot between a collapsed position and an extended position, comprising:

a handle member pivotably connected to a frame portion of a housing of a consumable item; and at least one arm pivotably engaging with the handle member and slidingly engaged with the frame portion;

wherein in the collapsed position, the handle member and the at least one arm are substantially flush with a surface of the housing.

15. The handle mechanism of claim 14, wherein the at least one arm includes a first end coupled to the handle member and a second end, and the frame portion includes a track for receiving the second end of the at least one arm.

16. The handle mechanism of claim 14, wherein the handle member and the at least one arm define a first angle and a second angle, the first angle being an angle between the handle member and the frame portion, the second angle being an angle between the at least one arm and the handle member, the first angle varying between about 25 degrees to about 35 degrees between the extended position and the collapsed position.

17. The handle mechanism of claim 16, wherein the first angle is from about 25 degrees to about 35 degrees when the handle member is in the extended position and about zero degrees when in the collapsed position.

18. The handle mechanism of claim 16, wherein the second angle is greater than 90 degrees when the handle member is in the extended position and about 180 degrees when in the collapsed position.

19. The handle mechanism of claim 14, wherein the handle member includes a substantially planar member to prevent a user's thumb from being slid underneath the handle member when in the extended position.

20. The handle mechanism of claim 14, wherein the handle member is bowed in a central portion thereof for facilitating initial grasping by a user when the handle mechanism is in the collapsed position.

21. The handle mechanism of claim 14, wherein the handle mechanism automatically returns to the collapsed position by gravity when released from a user's grip.

* * * * *